US009695606B1

(12) United States Patent
Allen, Jr.

(10) Patent No.: US 9,695,606 B1
(45) Date of Patent: Jul. 4, 2017

(54) ENGINEERED WOOD FLOORING REMOVAL APPARATUS FOR USE WITH BOTTOM PLY AND ADHESIVE LAYERS

(71) Applicant: John Sevier Allen, Jr., Kamiah, ID (US)

(72) Inventor: John Sevier Allen, Jr., Kamiah, ID (US)

( * ) Notice: Subject to any disclaimer, the term of this patent is extended or adjusted under 35 U.S.C. 154(b) by 0 days.

(21) Appl. No.: 14/704,887

(22) Filed: May 5, 2015

Related U.S. Application Data

(60) Provisional application No. 61/989,363, filed on May 6, 2014.

(51) Int. Cl.
*A47L 11/00* (2006.01)
*E04G 23/00* (2006.01)
*A47L 11/40* (2006.01)

(52) U.S. Cl.
CPC ..... *E04G 23/006* (2013.01); *A47L 11/4038* (2013.01)

(58) Field of Classification Search
CPC ..... A47L 11/4038; E04G 23/006
See application file for complete search history.

(56) References Cited

U.S. PATENT DOCUMENTS 1,193,407 A * 8/1916 Mitchell ..... B24B 7/186 451/353
3,464,166 A * 9/1969 Bouvier ..... B24D 13/14 451/548
4,541,207 A * 9/1985 Antonson ..... B24D 9/085 15/230.17
4,668,017 A * 5/1987 Peterson ..... B28D 1/18 299/109
5,514,027 A * 5/1996 Pearlman ..... B24B 7/186 125/38
5,683,143 A * 11/1997 Peterson ..... A47L 11/164 299/102
7,828,632 B2 * 11/2010 Palushi ..... B24B 7/186 451/350
2012/0118319 A1 * 5/2012 Stuchlik ..... A47L 11/293 134/6
2014/0045414 A1 * 2/2014 Di Mattia ..... B24B 7/186 451/529

* cited by examiner

*Primary Examiner* — Larry E Waggle, Jr.
*Assistant Examiner* — Henry Hong
(74) *Attorney, Agent, or Firm* — Plager Schack LLP

(57) ABSTRACT

An engineered wood flooring removal apparatus for use with a buffer machine to remove bottom ply and adhesive layers of the wood flooring is provided. The apparatus effectively dislodges the bottom ply and adhesive layers with enhanced efficiency while minimizing the production of hazardous airborne particulates. The apparatus includes a base member rotatably mounted to the buffer machine, a support pad coupled to the base member, a disc member coupled to the support pad, and a plurality of cutting members coupled to the disc member. Each cutting member has an upper exposed head and a lower member that extends through the disc member, the support pad and the base member. The upper exposed heads of the cutting members contact the bottom ply and adhesive layers of the engineered wood flooring and dislodge the layers during a rotation of the base member when the buffer machine is enabled.

6 Claims, 4 Drawing Sheets

ENGINEERED WOOD FLOORING REMOVAL APPARATUS FOR USE WITH BOTTOM PLY AND ADHESIVE LAYERS

RELATED APPLICATION

The application claims priority to provisional patent application U.S. Ser. No. 61/989,363 filed on May 6, 2014, the entire contents of which is herein incorporated by reference.

BACKGROUND

The embodiments herein relate generally to devices for removing engineered wood flooring from a building.

Engineered wood flooring that has been glued down to plywood sub-flooring is difficult to remove, especially after adhesive has cured. When industrial grade adhesives are used in the original installation, the lower levels of the floor ply bonds to the subfloor, making removal by standard sanding methods tedious, expensive, time-consuming, and hazardous due to airborne dust particles generated. Breaker bars and various types of manual and power chisels are used to remove the top layers of engineered wood flooring, but become ineffective when confronted with the lower bonded adhesive glue layers and ply layers of the engineered wood flooring. Sanding these lower floor layers with industrial drum and circular sanders with the coarsest grit sandpaper on the market results only in a labor-intensive smoothing down of the floor surface and/or production of dust clouds. These dust clouds contain fine particles, which are hazardous for users to breathe in. As such, current devices for removing engineered wood flooring are costly, ineffective, inefficient and unsafe.

As such, there is a need in the industry for an engineered wood flooring removal apparatus for use with bottom ply and adhesive layers, which effectively dislodges the layers while eliminating the generation of hazardous dust particles.

SUMMARY

An engineered wood flooring removal apparatus for use with a buffer machine to remove bottom ply and adhesive layers of the wood flooring is provided. The removal apparatus is configured to effectively dislodge the bottom ply and adhesive layers with enhanced efficiency while minimizing the production of hazardous airborne particulates. The removal apparatus comprises a base member rotatably mounted to the buffer machine, a support pad coupled to the base member, a disc member coupled to the support pad, and a plurality of cutting members coupled to the disc member and oriented generally in a pattern of concentric rings, each cutting member comprising an upper exposed head and a lower member that extends through the disc member, the support pad and the base member, wherein the upper exposed heads of the plurality of cutting members are configured to contact the bottom ply and adhesive layers of the engineered wood flooring and dislodge the layers during a rotation of the base member when the buffer machine is enabled.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
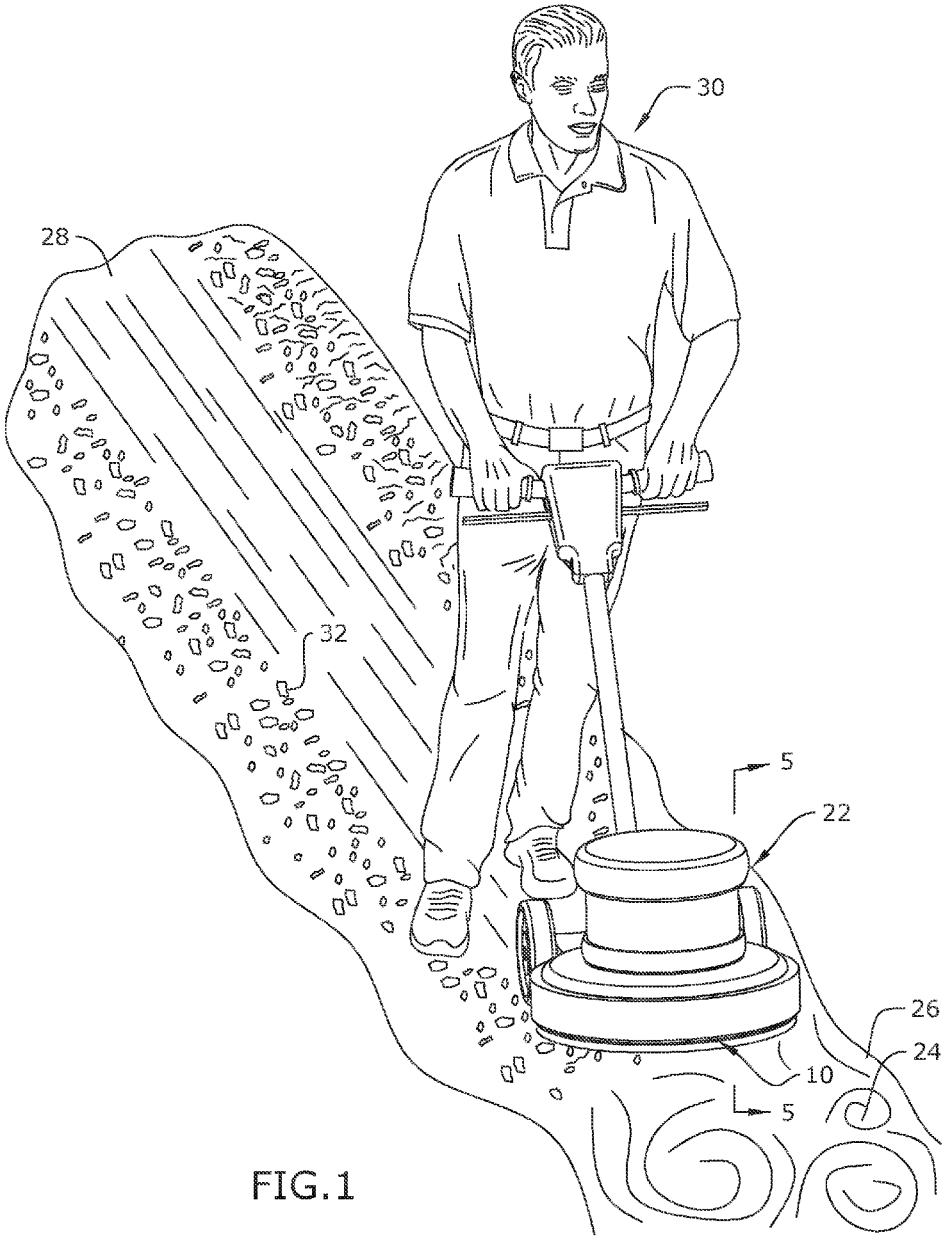
FIG. 1 depicts a perspective view of certain embodiments of the engineered wood flooring removal apparatus shown in use.
Figure 2:
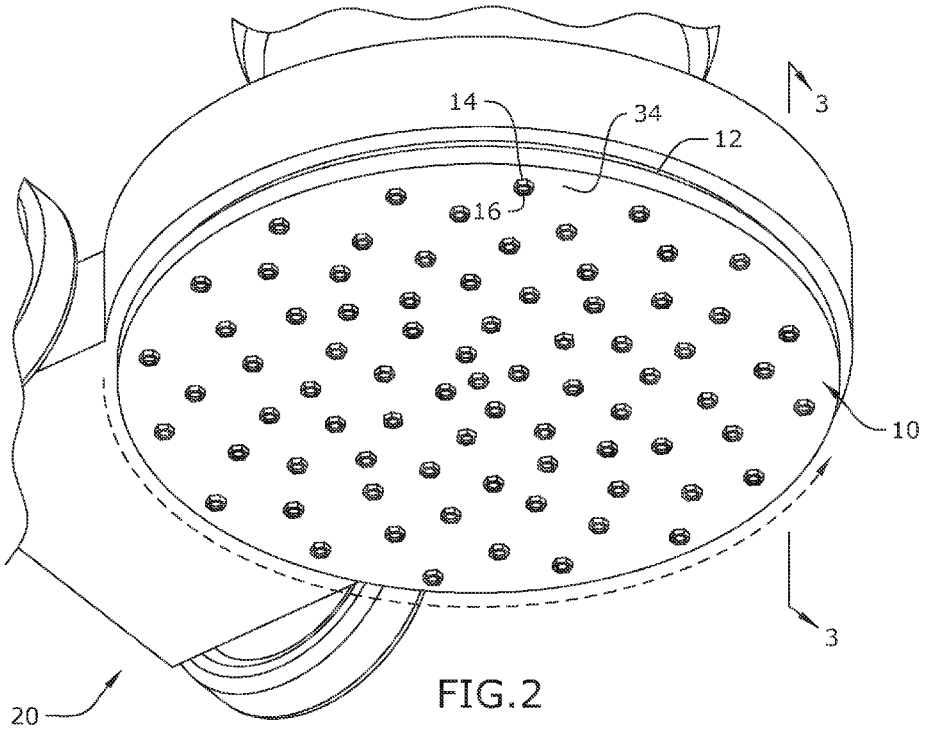
FIG. 2 depicts a bottom perspective view of certain embodiments of the engineered wood flooring removal apparatus.

As depicted in FIGS. 1-2, engineered wood flooring removal apparatus 10 is an attachment comprising disc member 34 configured for use with buffer machine 22 by operator 30 to remove bottom layers of engineered wood flooring into dislodged material 32. These bottom layers of flooring include bottom ply layer 24, adhesive layer 26 and subfloor layer 28 (ply strata). Buffer machine 22 may be any type known in the field and typically comprises nylon pad 18 and buffer base 20. The motor (not shown) of buffer machine 22 permits the rapid rotation of buffer base 20, nylon pad 18 and disc member 34 to aid in the removal of bottom engineered wood flooring layers.

It shall be appreciated that engineered wood flooring generally includes a top portion and a bottom portion comprising any number of bottom ply layers 24 and/or subfloor layers 28 bonded together by adhesive layers 26. Engineered wood flooring removal apparatus 10 is designed to remove the bottom layers of the wood flooring including any number of bottom ply layers 24 and adhesive layers 26 in a particular configuration. The top portion of engineered wood flooring (not shown) may be removed by using existing devices in the prior art such as breaker bars and various types of manual and power chisels.

Figure 3:
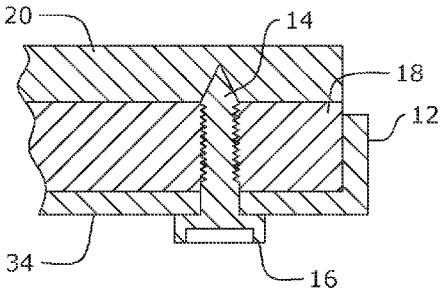
FIG. 3 depicts a section view of certain embodiments of the engineered wood flooring removal apparatus along line 3-3 in FIG. 2.
Figure 4:
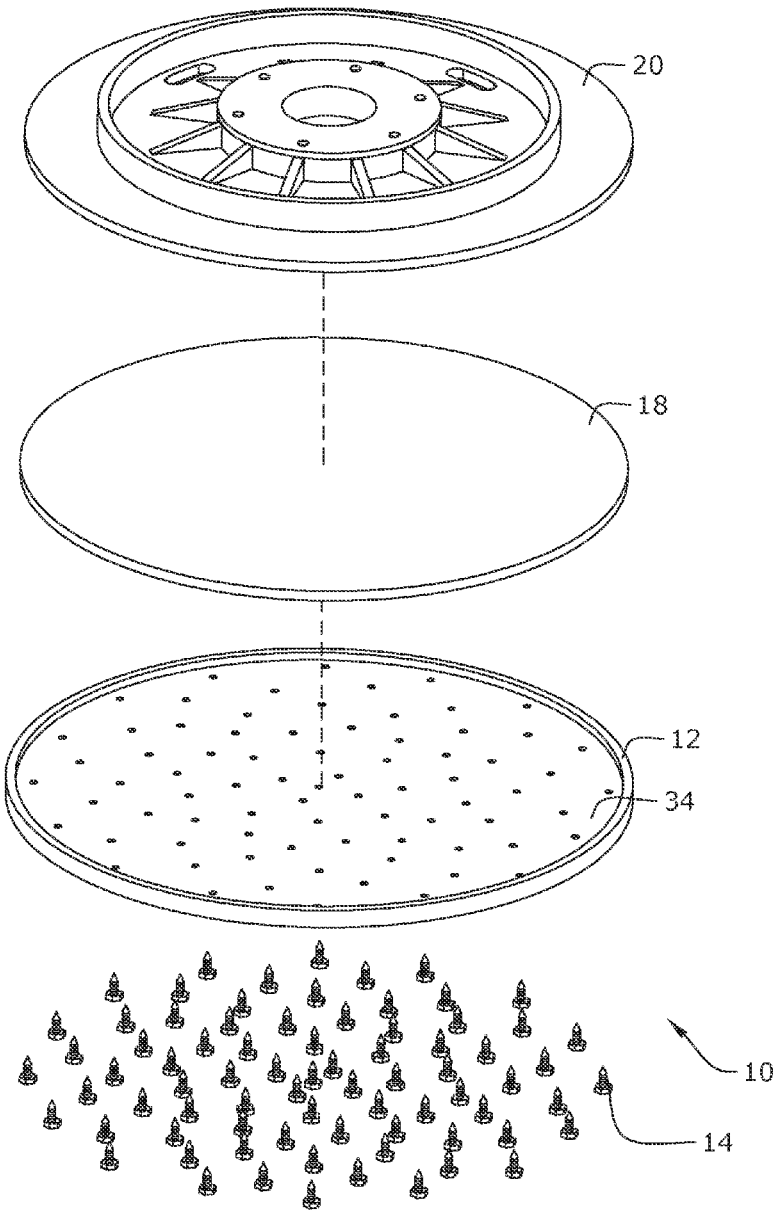
FIG. 4 depicts an exploded view of certain embodiments of the engineered wood flooring removal apparatus.

As depicted in FIGS. 2-4, disc member 34, nylon pad 18 and buffer base 20 are secured together. Buffer base 20 is a support member that is rotatably mounted to buffer machine 22. The rotation of buffer base 20 permits nylon pad 18 and disc member 34 to rotate when connected to buffer base 20. Nylon pad 18 is disposed on buffer base 20 to provide additional support and cushion to the apparatus when in use. Disc member 34 is disposed on nylon pad 18 and comprises rim 12 coupled along the edge of the member. Rim 12 provides additional support to secure nylon pad 18 in place within the space between buffer base 20 and disc member 34.

In a preferred embodiment, disc member 34 has approximate dimensions of 17.25"×0.375" and may be made from any materials known in the field such as a polymer or plywood. Cutting members 14 comprise recessed heads 16 and are coupled to disc member 34. In a preferred embodiment, cutting members 14 are roofing hex-screws with approximate dimensions of 0.3125"×0.1875"×0.75" long with a 0.0625" recessed, concave metal head. However, the dimensions and/or type of screws used may vary. In one embodiment, each cutting member 14 may have a washer (not shown) coupled to recessed head 16. As depicted in FIG. 3, recessed head 16 of each cutting member 14 is exposed and remains flush with the outer surface of disc member 34. The remaining portion of each cutting member 14 extends through nylon pad 18 and buffer base 20.

In a preferred embodiment, seventy-seven cutting members 14 are positioned on disc member 34 generally along a plurality of concentric rings from the center to the edge of the disc. It shall be appreciated that any alternative number of cutting members 14 may be used instead. Each cutting member 14 can be rotated +– 1.5 degrees relative to a radial line of disc member 34 in the final arrangement to permit an adjustment in positioning of the hex-shaped member of recessed head 16. These variations in the positioning of recessed heads 16 enhance the effectiveness of cutting members 14 in dislodging floor layers when in contact with bottom ply layer 24 and adhesive layer 26. Specifically, this maximizes the cutting edge exposure of the hex-screws, which facilitates a more efficient evacuation of demolished flooring material.

Figure 5:
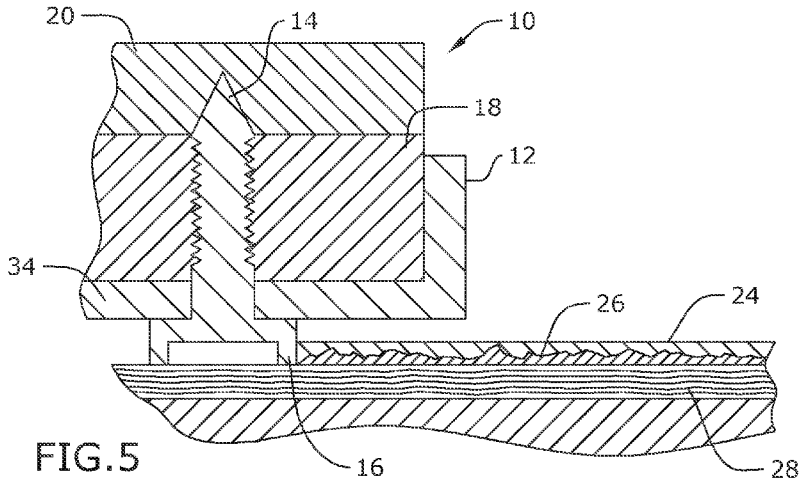
FIG. 5 depicts a section view of certain embodiments of the engineered wood flooring removal apparatus shown in use.

In operation, engineered wood flooring removal apparatus 10 is assembled with buffer machine 22. Specifically, disc member 34, cutting members 14, nylon pad 18 and buffer base 20 are coupled together as described above. Operator 30 enables buffer machine 22, which rotates disc member 34 and cutting members 14. Operator 30 pushes buffer machine 22 along a path to remove bottom ply layer 24 and adhesive layer 26 from the bottom portion of engineered wood flooring as depicted in FIG. 1. The removed layers are swept to the side in the form of dislodged material 32. As depicted in FIG. 5, recessed head 16 of each cutting member 14 contacts bottom ply layer 24 and adhesive layer 26.

Figure 6:
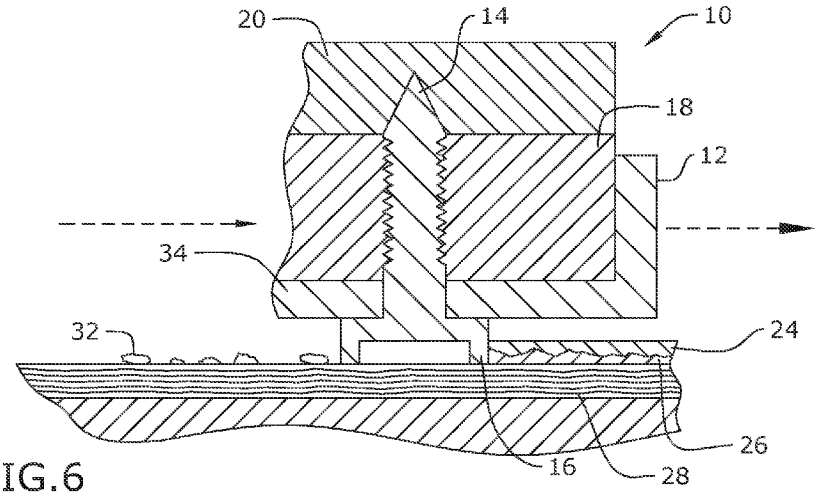
FIG. 6 depicts a section view of certain embodiments of the engineered wood flooring removal apparatus shown in use.

As disc member 34 spins, the strategically placed, offset recessed heads 16 tear into and expeditiously pulverize bottom ply layer 24 and adhesive layer 26 as depicted in FIG. 6. During this process, the concave metal recessed heads 16 force-multiply the cutting capacity of the apparatus. The centrifugal force of spinning disc member 34, combined with the offset and positioning of recessed heads 16 push dislodged material 32 to the outside of the spin zone. This allows a user to easily clean up the resulting debris field and remnants of the engineered wood flooring. Since the resulting debris consists of distinct pieces, hazardous dust particles are not created as in conventional sanding techniques. It is estimated that the present apparatus creates demolished particles that are 850-1250 microns. In contrast, demonstrations have shown that the sanding of glue and ply material produces hazardous ambient dust particles of approximately 100 microns.

It shall be appreciated that engineered wood flooring removal apparatus 10 described in several embodiments herein may comprise any alternative known materials in the field and be of any color, size and/or dimensions. It shall be appreciated that the components of engineered wood flooring removal apparatus 10 described herein may be manufactured and assembled using any known techniques in the field such as wood machining techniques, injection mold processes, or the like.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An engineered wood flooring removal apparatus for use with a buffer machine to remove bottom ply and adhesive layers of the wood flooring, the removal apparatus configured to effectively dislodge the bottom ply and adhesive layers with enhanced efficiency while minimizing a production of hazardous airborne particulates, the removal apparatus comprising;

a base member rotatably mounted to the buffer machine; wherein the base member further comprises a circular lower surface;

a support pad coupled to the base member; wherein the support pad further comprises a support pad edge and a support pad lower surface; wherein the support pad completely covers the base member lower surface;

a disc member coupled to the support pad; wherein the disc member completely covers the support pad lower surface and most of the support pad edge and over two dozen cutting members inserted through the disc member through the support pad and into the base member; the over two dozen cutting members are oriented generally in a pattern of concentric rings, each cutting member comprising an upper exposed head and a lower member that extends through the disc member, the support pad and the base member, wherein the upper exposed heads of the over two dozen cutting members are configured to contact the bottom ply and adhesive layers of the engineered wood flooring and dislodge the layers during a rotation of the base member when the buffer machine is enabled.

2. The engineered wood flooring removal apparatus of claim 1, wherein the cutting members comprises hex-head screws.

3. The engineered wood flooring removal apparatus of claim 2, further comprising a rim coupled to an edge of the disc member and configured to contact the edge of the support pad.

4. The engineered wood flooring removal apparatus of claim 3, wherein the support pad is made from nylon.

5. The engineered wood flooring removal apparatus of claim 4, wherein the disc member is made from plywood.

6. The engineered wood flooring removal apparatus of claim 4, wherein the disc member is made from a polymer.

* * * * *